US009962009B2

(12) United States Patent
Krim et al.

(10) Patent No.: US 9,962,009 B2
(45) Date of Patent: May 8, 2018

(54) MATTRESS

(71) Applicant: Casper Sleep, Inc., New York, NY (US)

(72) Inventors: Philip Krim, New York, NY (US); Neil Parikh, Toms River, NJ (US); Jeff Chapin, Providence, RI (US); David Holm, San Francisco, CA (US)

(73) Assignee: Casper Sleep Inc., New York, NY (US)

( * ) Notice: Subject to any disclaimer, the term of this patent is extended or adjusted under 35 U.S.C. 154(b) by 0 days. days.

(21) Appl. No.: 15/405,906

(22) Filed: Jan. 13, 2017

(65) Prior Publication Data

US 2017/0119169 A1 May 4, 2017

Related U.S. Application Data

(63) Continuation-in-part of application No. 14/689,945, filed on Apr. 17, 2015.

(60) Provisional application No. 61/982,235, filed on Apr. 21, 2014.

(51) Int. Cl.

| | |
|---|---|
| ***A47C 27/15*** | (2006.01) |
| ***A47C 21/04*** | (2006.01) |
| ***A47C 27/14*** | (2006.01) |

(52) U.S. Cl.

CPC ..... *A47C 27/15* (2013.01); *A47C 21/046* (2013.01); *A47C 27/148* (2013.01)

(58) Field of Classification Search

CPC ..... A47C 27/15
USPC ..... 5/653–654, 740, 724, 652.1
See application file for complete search history.

(56) References Cited

U.S. PATENT DOCUMENTS

| | | | | |
|---|---|---|---|---|
| 6,175,890 | B1 | 1/2001 | Gaither | |
| 9,085,125 | B2 | 7/2015 | Gesquiere | |
| 2003/0181538 | A1 | 9/2003 | Martel et al. | |
| 2005/0210595 | A1 | 9/2005 | Di Stasio et al. | |
| 2009/0089933 | A1 | 4/2009 | Letton | |
| 2010/0058541 | A1* | 3/2010 | Kemper | A47C 27/001 5/701 |
| 2010/0087561 | A1 | 4/2010 | Abraham et al. | |
| 2010/0160473 | A1 | 6/2010 | Neff et al. | |
| 2010/0269262 | A1 | 10/2010 | Warren et al. | |
| 2011/0061168 | A1 | 3/2011 | Farley | |
| 2011/0252572 | A1* | 10/2011 | Morrison | A47C 27/144 5/740 |

(Continued)

OTHER PUBLICATIONS

Third-Party Submission Under 37 CFR 1.290 dated Jun. 14, 2016 in related case U.S. Appl. No. 14/689,945.

(Continued)

*Primary Examiner* — Fredrick C Conley
(74) *Attorney, Agent, or Firm* — Koffsky Schwalb LLC; Mark I. Koffsky

(57) ABSTRACT

A foam mattress in which a layer of latex or latex-like foam placed above two layers of memory foam is described. This construction of the mattress provides the contouring pressure relief that a visco-elastic foam provides with a top surface with quick recovery (a latex-like "bounce") that prevents people from getting "stuck" in the visco-elastic foam and improves the springiness of the mattress. The mattress may also include straps and cinches to aid in transportation of the mattress. The mattress may also include removable covers that aid in keeping the mattress clean.

7 Claims, 10 Drawing Sheets

(56) References Cited

U.S. PATENT DOCUMENTS

| | | | | |
|---|---|---|---|---|
| 2013/0263386 | A1 | 10/2013 | Romero et al. | |
| 2014/0039082 | A1* | 2/2014 | Peterson | C08J 9/0066 521/170 |
| 2015/0296995 | A1 | 10/2015 | Krim et al. | |

OTHER PUBLICATIONS

Third-Party Submission Under 37 CFR 1.290 dated Jun. 27, 2016 in related case U.S. Appl. No. 14/689,945.
Third-Party Submission Under 37 CFR 1.290 dated Jun. 10, 2016 in related case U.S. Appl. No. 14/689,945.
International Search Report. Written Opinion of ISA and Search History, PCT/US2015/026564, dated Aug. 31, 2015.
Communication from Thomas Petr received in corresponding PCT application, PCT/US2015/026564, dated Feb. 27. 2016.
Supplementary Partial European Search Report for EP 15 78 3835 (dated Nov. 14, 2017).

* cited by examiner

MATTRESS

RELATED APPLICATIONS

This application is a continuation-in-part of U.S. patent application Ser. No. 14/689,945, filed on Apr. 17, 2015 which claims the benefit of the U.S. Provisional Patent Application Ser. No. 61/982,235 filed on Apr. 21, 2014.

FIELD OF THE DISCLOSURE

The present disclosure is directed to a foam mattress with improved features related to its construction, transportation and cleaning.

BACKGROUND

Although the traditional spring mattress is the dominant category of mattresses sold within the United States, both latex foam mattresses and visco-elastic (memory) foam mattresses have been sold in the U.S. as specialty-category mattresses.

Both latex and memory foams have benefits and drawbacks in mattress construction and design. Latex foam has a very quick recovery rate (i.e., is "bouncy"), is highly breathable and can be produced using natural or synthetic materials. If natural materials are used, the mattress can be marketed as such, adding to its desirability in the marketplace. Nonetheless, latex foam mattresses have the highest average return rate of any type of mattress sold in the U.S.—usually due to the resonant "bouncing" that the user feels on a latex foam mattress and/or inadequate pressure relief.

The market for memory foam mattresses was built nearly single-handedly by Tempur-Pedic through novel marketing techniques, such as an association with space-age technology and the image of a handprint "stuck" in the foam top layer after the hand is removed. Due to its slow recovery (or memory), visco-elastic memory foam was marketed as an aid for pressure relief and to enable isolation of one sleeper from another because the foam does not translate vibration. But memory foam mattresses also have a somewhat high return rate, often due to complaints such as: 1) "getting stuck" (i.e., not being able to turn over when changing sleeping positions); 2) overheating (the foam is not highly breathable and the contouring causes the foam to closely hug large portions of the body limiting air flow); and 3) not being conducive for comfort during sex because of the tendency to "get stuck."

Further, both latex and memory foam are expensive materials. Manufacturers often use them only for the top layer(s) of a mattress, often referred to as the comfort layer(s). The comfort layer(s) are usually 1-5" thick and typically consist of 1-3 different foam types laminated together. Beneath these layer(s), regular polyurethane foam is typically used to provide some support and to increase mattress thickness. Some newer "hybrid" mattresses use pocketed spring coils instead of polyurethane foam. To combat the "stuck" feeling of memory foam, some manufacturers have developed quick-response memory foam. Other manufacturers use thinner layers of memory foam (atop poly foam) to limit the depth that user can sink into the foam. A few manufacturers have put latex foam underneath the memory foam to benefit from the quick return (i.e. bounce) that the latex foam provides. But this solution may not solve the problems noted above where memory foam is the top layer of the mattress.

Accordingly, there is a need for a novel foam mattress construction that couples the contouring pressure relief of memory foam with quick-recovery of latex foam that prevents users from getting "stuck" in the memory foam and improves the springiness of the mattress. Such an arrangement will benefit from the breathability and bounciness of latex foam while mitigating the resonant bouncing and poorer pressure relief characteristics of latex foam.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
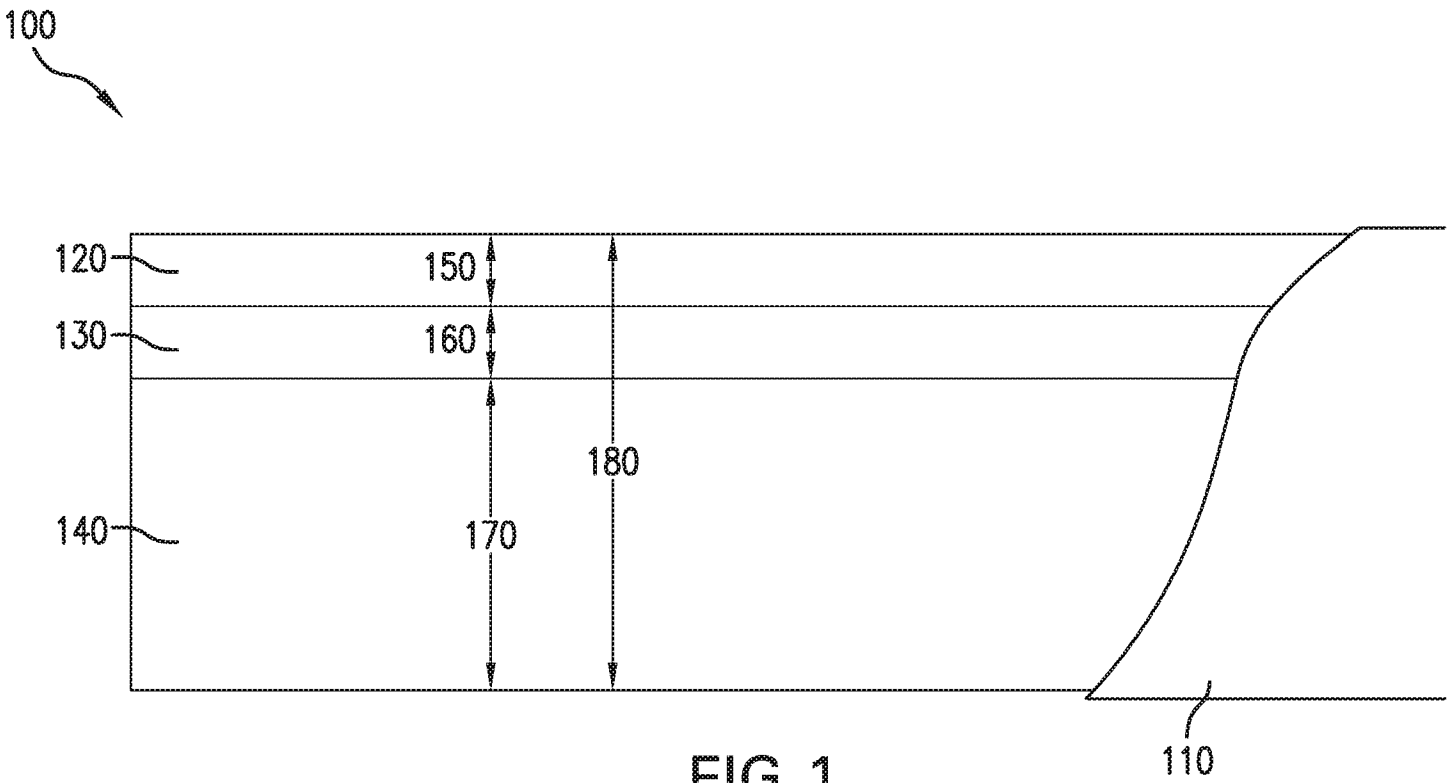
FIG. 1 is a cross-section view of a three-layer mattress in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

I. Definitions

In this disclosure, the listed terms will be defined as follows:

Density of a foam is its mass per unit volume. Density may be measured in pounds per cubic foot (pcf).

IFD is Indentation Force Deflection, which is a method for determining the firmness, and load bearing capacity of foam. IFD measures the load required to depress a 50 square inch compression platen into a foam specimen. IFD is usually reported at 25% deflection of the specimen's height and is measured in pounds. IFD may be measured with ASTM D3574-11 Test $B_1$.

Airflow is a measure of the air permeability of a foam and is measured in cubic feet per minute (cfm). Airflow may be measured with ASTM D3574-11 Test G.

Recovery is a measure of how quickly a foam returns to original shape after being displaced and is measured in seconds. Recovery is typically used to measure the memory effect of visco-elastic foams. Recovery may be measured with ASTM D3574-11 Test M.

Rebound is measure of the elasticity of a foam and is measured as a percentage. A steel ball is dropped on a foam specimen, and the percentage height it rebounds (relative to drop height) is measured. Rebound may be measured with ASTM D3574-11 Test H Support Factor (SF) is the ratio of 65% IFD over 25% IFD and is a unitless measurement. SF is a measure of the "deeper" support of a foam, and is an indicator as to whether a foam will bottom out or not. SF may be measured with ASTM D3574-11 Test $B_1$.

Tg is the glass transition temperature of the foam. It is a property of all foams but is most relevant with memory foams because memory foams have a Tg within the range of normal ambient temperature (40° F.-80° F.). Tg is the point at which a foam transitions from stiff to pliable. Below Tg, a foam is stiff. Above Tg, a foam is pliable. The transition in mechanical properties can be dramatic, even with but a few degrees change in temperature. Tg, may be measured with dynamic mechanical analysis (DMA) or thermal stress analysis (TSA).

Latex foam is any high resilience foam where: i) a rebound may be greater than 40%; ii) airflow may be greater than 3.5 cfm; and iii) recovery may be less than 0.5 seconds. Latex foam may be natural latex, styrene butadiene rubber (SBR), polyurethane or any blend of the above foams.

Latex-like foam is any foam intended to simulate the mechanical properties of latex foam—(i) a rebound may be greater than 40%; ii) airflow may be greater than 3.5 cfm; and iii) recovery may be less than 0.5 seconds—but with polyurethane, polyethylene or other non-natural or non-SBR resins or any blend of the above foams. In the alternative, latex-like foam may have the following properties: (i) a rebound may be greater than 35%; and ii) airflow may be 4 cfm or greater.

Memory foam is any polyurethane foam with a low rebound, delayed recovery and a temperature-sensitive response. More specifically: i) the rebound may be from 1-2%; ii) the recovery may be greater than 1 second; and iii) the temperature-sensitive response may be the foam softening in response to body heat and having a Tg between 40° F. and 80° F. In the alternative, memory foam may have the following properties: (i) the rebound may be 1% or less; ii) the airflow may be 2 cfm or greater; (iii) the recovery may be about 6 seconds; and iv) the temperature-sensitive response may be the foam softening in response to body heat and having a Tg of 50° F. or less.

Transition foam is any polyurethane foam of modified visco-elastic polyurethane foam without a "memory foam" feature. Transition foam may have the following properties: (i) the rebound may be about 10%; and ii) the airflow may be 1.5 cfm or more.

II. Mattress Length and Width

The mattresses described herein may be of any suitable length and width, including without limitation U.S. or non-U.S. standard sizes such as King, Queen, Full, Twin, Extra Long, California King, Youth and Crib.

III. The Three-Layer Mattress

Turing to FIG. 1, shown is cross-section of a three-layer mattress 100 with a cover 110. The cross-section of the depth of the mattress 100 includes a first layer 120, a second layer 130 and a third layer 140.

A. First Embodiment

In a first embodiment, the total depth 180 of the mattress 100 may be 9.5 inches. The first layer depth 150 of the mattress 100 may be 1.5 inches. The second layer depth 160 of the mattress may be 1.5 inches. The third layer depth 170 of the mattress may be 6.5 inches.

In this first embodiment, the first layer 120 is a layer of latex foam. The first layer 120 may consist of C1 latex from Mountain Top Foam and may have the physical properties shown in Table 1.

TABLE 1

| | Target | Tolerance | Unit | Test Method | Potential Range | Unit |
|---|---|---|---|---|---|---|
| Density | 3.3 | ±0.2 | pcf | n/a | 2 to 4 | pcf |
| 25% IFD | 12 | ±1 | lb | ASTM D3574-11 Test $B_1$ | 6 to 18 | lb |
| Airflow | >4 | minimum | cfm | ASTM D3574-11 Test G | >2 | cfm |
| Recovery | <0.5 | maximum | seconds | ASTM D3574-11 Test M | <1 | seconds |
| Rebound | 65 | ±5 | % | ASTM D3574-11 Test H | >40 | % |
| Support Factor | 3 | ±0.1 | n/a | ASTM D3574-11 Test $B_1$ | >2 | n/a |
| Tg | | | | n/a | | |

In Table 1, the rightmost two columns demonstrate potential ranges of physical properties related to the first layer 120.

The second layer 130 is a layer of memory foam. The second layer 130 may consist of 4 lb Visco memory foam and may have the physical properties shown in Table 2.

TABLE 2

| | Target | Tolerance | Unit | Test Method | Potential Range | Unit |
|---|---|---|---|---|---|---|
| Density | 4.0 | ±0.1 | pcf | n/a | 2 to 6 | pcf |
| 25% IFD | 10 | ±1 | lb | ASTM D3574-11 Test $B_1$ | 6 to 18 | lb |
| Airflow | >2 | minimum | cfm | ASTM D3574-11 Test G | >1 | cfm |
| Recovery | 3 | ±1 | seconds | ASTM D3574-11 Test M | >1 | seconds |
| Rebound | 2 | maximum | % | ASTM D3574-11 Test H | <5 | % |

TABLE 2-continued

| | Target | Tolerance | Unit | Test Method | Potential Range | Unit |
|---|---|---|---|---|---|---|
| Support Factor | 2.2 | ±0.1 | n/a | ASTM D3574-11 Test $B_1$ | <2.6 | n/a |
| Tg | 60 | ±2 | ° F. | DMA | 40 to 80 | ° F. |

In Table 2, the rightmost two columns demonstrate potential ranges of physical properties related to the second layer 130.

In the mattress industry, two important parameters used to describe a foam are IFD and SF. Standard test protocols specify the test specimen size and loading regime for these parameters, which creates measurement consistency. Such test protocols may be found in ASTM D3574-11.

IFD is an indication of foam firmness and indicates how much force a foam pushes back with when a user pushes into it. Industry norms use 25% IFD numbers as a basis for comparison—so an IFD 8 foam (8 pounds of push-back) feels softer than a IFD 20 foam (20 pounds of push-back).

SF represents the "deeper" support of a foam, and is an indicator as to whether a foam will bottom out or not. SF is the ratio of the 65% IFD to the 25% IFD—the ratio of the force required to depress a sample to 65% of its original height to the force required to depress a sample to 25% of its original height (the standard IFD measurement). SF illustrates how much a single type of foam pushes back the more the user pushes into it. Thus, a foam with a SF of 3 and an IFD of 8 pushes back with 24 pounds force upon 65% compression, while an IFD 8 foam with a SF of 2 only pushes back with 16 pounds at 65% compression.

A linear "spring" foam generally has a SF of 2.6. Latex and latex-like foam typically have a higher SF (approximately 3.0-3.3). Memory foam typically has a lower SF (approximately 2.0-2.2). These differences are quite significant in the overall feel of the mattress.

In the mattress industry, it has been a widely accepted rule of thumb that the top layers of foam should have the lowest SF to reduce pressure points, and that the SF should increase as one moves down into the layers. By having the first layer 120 being comprised of a latex or latex-like foam and placed on top of the second layer 130 being comprised of memory foam, the commonly-held rule regarding SF is inverted. Nonetheless, a successful experience for the mattress user is achieved because the foam layers of the bed act as a series of springs. This arrangement eliminates the "stuckness" of memory foam while retaining the pressure relief and motion isolation of the memory foam. At the same time, this arrangement benefits from the breathability and bounciness of latex or latex-like foam while mitigating the resonant bouncing and poorer pressure relief characteristics of latex or latex-like foam.

The third layer 140 adds overall support and depth for the mattress and may consist of 1.8 pcf conventional polyurethane foam and may have the physical properties shown in Table 3.

TABLE 3

| | Target | Tolerance | Unit | Test Method | Potential Range | Unit |
|---|---|---|---|---|---|---|
| Density | 1.8 | ±0.1 | Pcf | n/a | 1 to 4 | pcf |
| 25% IFD | 32 | ±3 | Lb | ASTM D3574-11 Test $B_1$ | 15 to 50 | lb |
| Airflow | >4 | minimum | Cfm | ASTM D3574-11 Test G | >2 | cfm |
| Recovery | <0.5 | maximum | Seconds | ASTM D3574-11 Test M | <1 | seconds |
| Rebound | 50 | ±5 | % | ASTM D3574-11 Test H | >40 | % |
| Support Factor | 1.9 | ±0.1 | n/a | ASTM D3574-11 Test $B_1$ | 1.5 to 3.5 | n/a |
| Tg | | | | n/a | | |

In Table 3, the rightmost two columns demonstrate potential ranges of physical properties related to the third layer 140.

B. The Second Embodiment

In a second embodiment, the total depth 180 of the mattress 100 may range from 1 to 22 inches. The first layer depth 150 of the mattress 100 may range from 0.25 to 5 inches. The second layer depth 160 of the mattress may range from 0.25 inches to 5 inches. The third layer depth 170 of the mattress may range from 0.5 to 12 inches.

The second embodiment is similar to the first embodiment in that the first layer 120 is latex or latex-like foam and the second layer 130 is memory foam. The third layer 140 may be any of the following: i) latex foam; ii) latex-like foam; iii) polyurethane visco-elastic "memory" foam; iv) conventional polyurethane foam; v) HR (high resilience) polyurethane foam; or vi) any other polyurethane, polyethylene or polyester Foam.

IV. The Four-Layer Mattress

Figure 2:
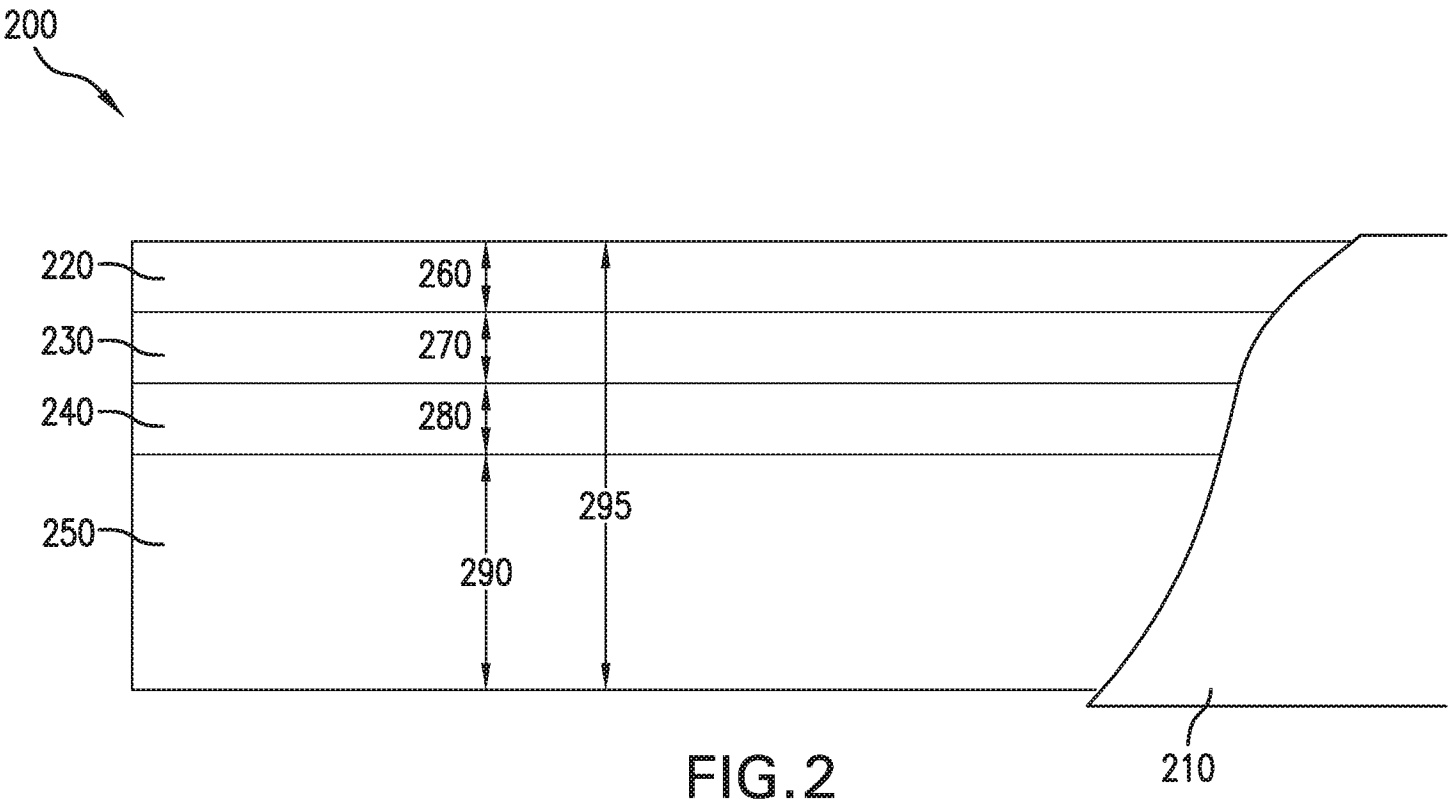
FIG. 2 is a cross-section view of a four-layer mattress in accordance with some embodiments.

Turing to FIG. 2, shown is cross-section of a four-layer mattress 200 with a cover 210. The cross-section of the depth of the mattress 200 includes a first layer 220, a second layer 230, a third layer 240 and a fourth layer 250.

A. The First Embodiment

The total depth 295 of the mattress 200 may range from 1 to 22 inches. The first layer depth 260 of the mattress 200 may range from 0.25 to 5 inches. The second layer depth 270 of the mattress may range from 0.25 inches to 5 inches. The third layer depth 280 of the mattress may range from 0.25 to 5 inches. The fourth layer depth 290 of the mattress may range from 0.25 to 12 inches.

The first layer 220 may be latex or latex-like foam. The second layer 230, third layer 240 and fourth layer 250 may be any of the following: i) latex foam; ii) latex-like foam; iii) polyurethane visco-elastic "memory" foam; iv) conventional polyurethane foam; v) HR (high resilience) polyurethane foam; or vi) any other polyurethane, polyethylene or polyester foam. In one embodiment, at least one of the second layer 230, third layer 240 and fourth layer 250 is memory foam. In one embodiment, at least one upper layer has a SF higher than a layer below that upper layer.

B. The Second Embodiment

In a second embodiment, the total depth 295 of the mattress 200 may be approximately 9.5 inches±0.5 inches. The first layer depth 260 of the mattress 200 may be approximately 1.5 inches±0.125 inches. The second layer depth 270 of the mattress may be approximately 1.5 inches±0.125 inches. The third layer depth 280 of the mattress may be approximately 1.5 inches±0.125 inches. The fourth layer depth 290 of the mattress may be approximately 5 inches±0.125 inches.

In the second embodiment, the first layer 220 may be a latex-like foam. The first layer 220 may have the physical properties shown in Table 4.

TABLE 4

| | Target | Tolerance | Unit | Test Method |
|---|---|---|---|---|
| Density | 3.5 | ±0.2 | pcf | n/a |
| 25% IFD | 13 | ±2 | lb | ASTM D3574-11 Test $B_1$ |
| Airflow | >4 | minimum | cfm | ASTM D3574-11 Test G |
| Recovery | | | n/a | |
| Rebound | >35 | minimum | % | ASTM D3574-11 Test H |
| Support Factor | 2.5 | ±0.2 | n/a | ASTM D3574-11 Test $B_1$ |
| Tg | | | n/a | |

The second layer 230 may be a layer of memory foam. The second layer 230 may consist of visco-elastic memory foam and may have the physical properties shown in Table 5.

TABLE 5

| | Target | Tolerance | Unit | Test Method |
|---|---|---|---|---|
| Density | 3.5 | ±0.2 | pcf | n/a |
| 25% IFD | 15 | ±2 | lb | ASTM D3574-11 Test $B_1$ |
| Airflow | >2 | minimum | cfm | ASTM D3574-11 Test G |
| Recovery | 6 | ±2 | seconds | ASTM D3574-11 Test M |
| Rebound | <1 | maximum | % | ASTM D3574-11 Test H |
| Support Factor | 2.2 | ±0.2 | n/a | ASTM D3574-11 Test $B_1$ |
| Tg | <50 | maximum | ° F. | DMA |

The third layer 240 may be a layer of transition foam. The third layer 240 may consist of modified visco-elastic polyurethane foam without a "memory foam" feature and may have the physical properties shown in Table 6.

TABLE 6

| | Target | Tolerance | Unit | Test Method |
|---|---|---|---|---|
| Density | 2.5 | ±0.1 | pcf | n/a |
| 25% IFD | 26 | ±2 | lb | ASTM D3574-11 Test $B_1$ |
| Airflow | >1.5 | minimum | cfm | ASTM D3574-11 Test G |
| Recovery | | | n/a | |
| Rebound | 10 | ±2 | % | ASTM D3574-11 Test H |
| Support Factor | 2 | ±0.2 | n/a | ASTM D3574-11 Test $B_1$ |
| Tg | | | n/a | |

The use of this third layer 240 may provide a more seamless transition between the second layer 230 and the fourth layer 250 and increases long-term durability of the mattress.

The fourth layer 250 may consist of polyurethane foam. This layer adds overall support and depth for the mattress and may consist of 1.8 pcf conventional polyurethane foam and may have the physical properties shown in Table 7.

TABLE 7

| | Target | Tolerance | Unit | Test Method |
|---|---|---|---|---|
| Density | 1.8 | ±0.1 | pcf | n/a |
| 25% IFD | 36 | ±3 | lb | ASTM D3574-11 Test $B_1$ |
| Airflow | >4 | minimum | cfm | ASTM D3574-11 Test G |
| Recovery | | | n/a | |
| Rebound | | | n/a | |
| Support Factor | 2 | ±0.2 | n/a | ASTM D3574-11 Test $B_1$ |
| Tg | | | n/a | |

The Five-Layer Mattress

Figure 3:
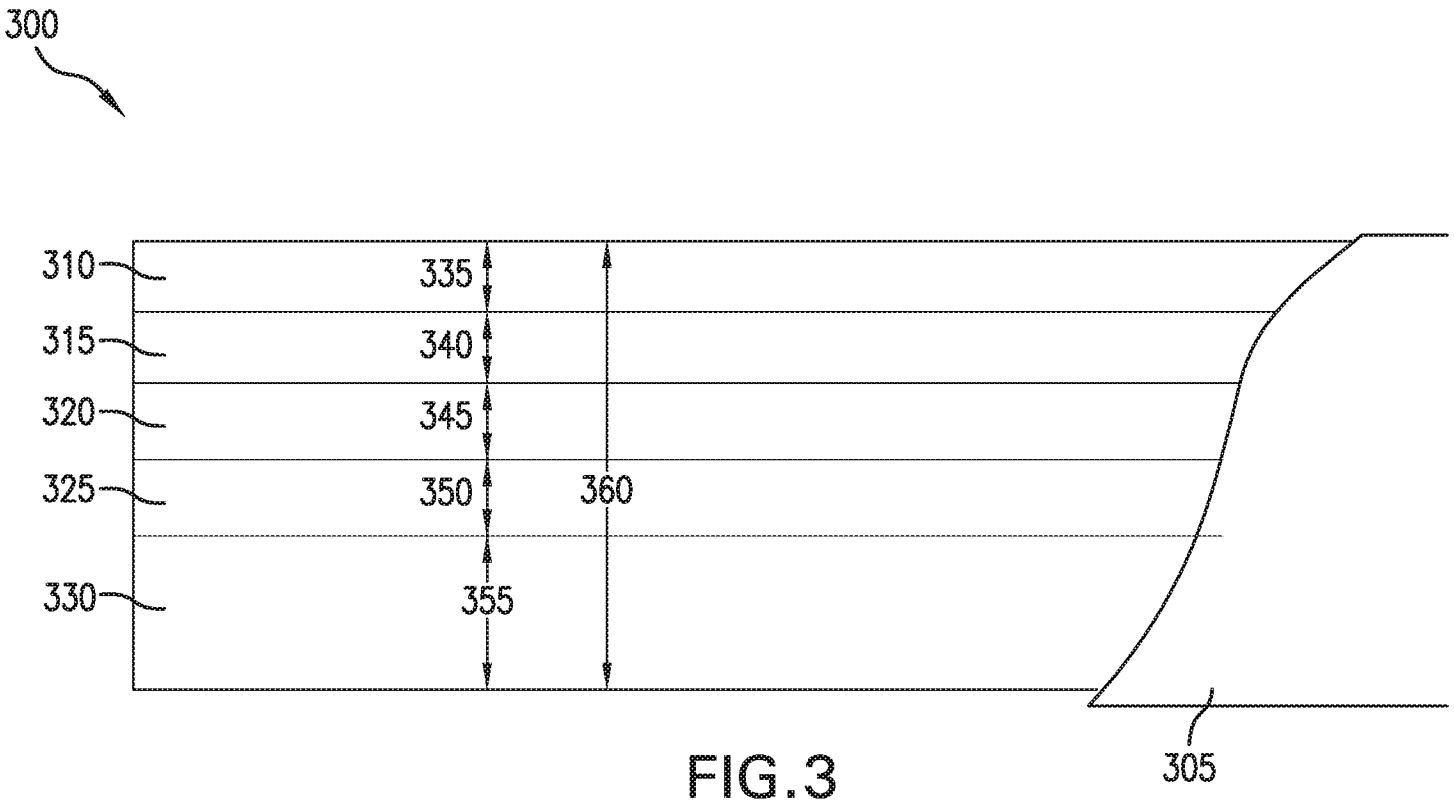
FIG. 3 is a cross-section view of a five-layer mattress in accordance with some embodiments.

Turing to FIG. 3, shown is cross-section of a five-layer mattress 300 with a cover 305. The cross-section of the depth of the mattress 300 includes a first layer 310, a second layer 315, a third layer 320, a fourth layer 325 and a fifth layer 330.

The total depth 360 of the mattress 300 may range from 1.25 to 22 inches. The first layer depth 335 of the mattress 300 may range from 0.25 to 5 inches. The second layer depth 340 of the mattress may range from 0.25 inches to 5 inches. The third layer depth 345 of the mattress may range from 0.25 to 5 inches. The fourth layer depth 350 of the mattress may range from 0.25 to 5 inches. The fifth layer depth 355 of the mattress may range from 0.25 to 12 inches.

The first layer 310 may be latex or latex-like foam. The second layer 315, third layer 320, fourth layer 325 and fifth layer 330 may be any of the following: i) latex foam; ii) latex-like foam; iii) polyurethane visco-elastic "memory" foam; iv) conventional polyurethane foam; v) HR (high resilience) polyurethane foam; or vi) any other polyurethane, polyethylene or polyester Foam. In one embodiment, at least one of the second layer 315, third layer 320, fourth layer 325 and fifth layer 330 is memory foam. In one embodiment, at least one upper layer has a SF higher than a layer below that upper layer.

VI. Mattress Transportation

Moving a mattress is a cumbersome task. For example, queen-sized mattresses can weigh up to 100 pounds, and are typically floppy with poor affordance for carrying. They are difficult to get through doorways, down stairs and into cars. As such, many people will discard mattresses when they move because the burdens and costs of moving a mattress are too great.

Figure 4A:
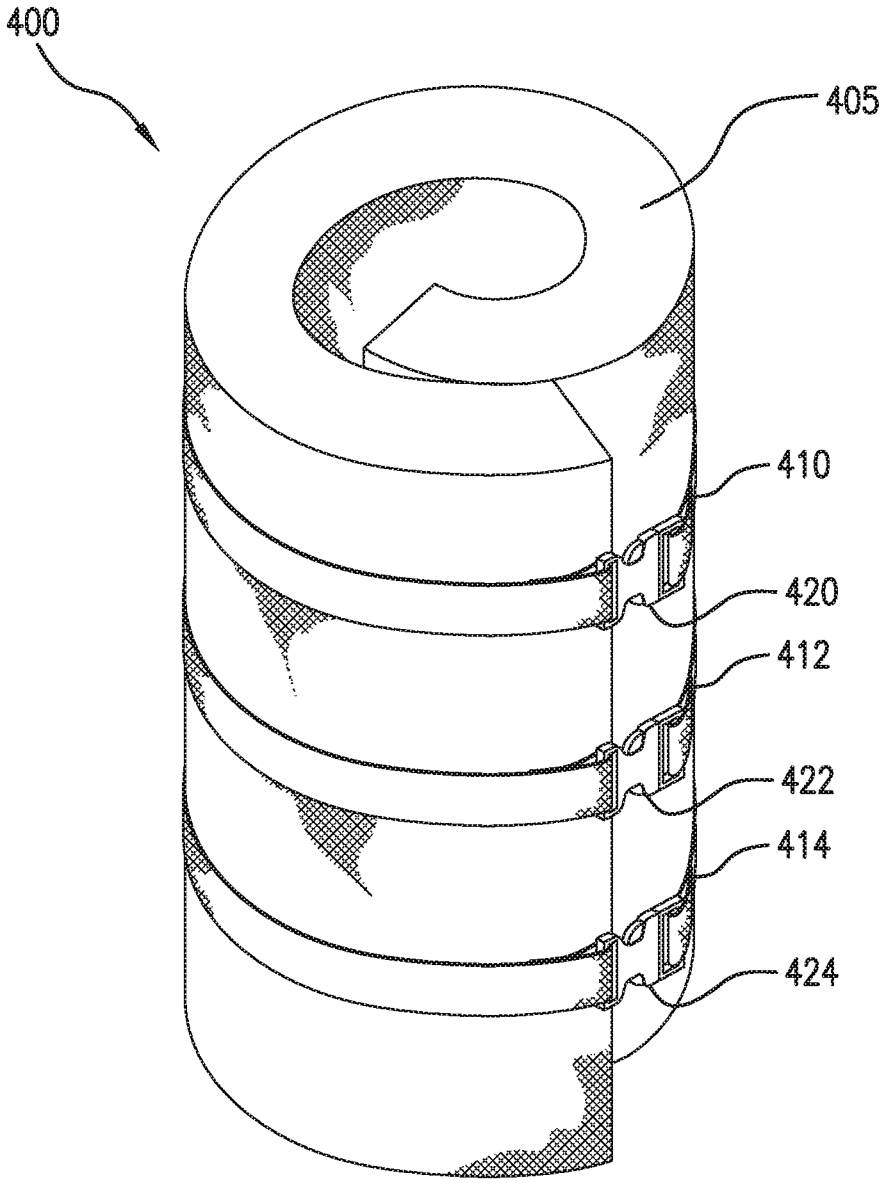
FIGS. 4A and 4B are perspective views of a rolled-up mattress in accordance with some embodiments.

Turing to FIG. 4A, shown is a mattress system 400 with two features that facilitate moving so that mattresses are not discarded and have greater long-term value to their owner. The mattress body 405 incorporates straps 410, 412, 414 integrated into the design that hold the mattress in an easily transportable shape once rolled up or folded. The straps may be webbing, string or any other material with high tensile strength. The straps may tie, have buckles or incorporate any other fasteners 420, 422, 424 that enable the straps to hold the mattress together. The user manually rolls up and/or folds the mattress, and the straps are located in a convenient place such that once rolled, the mattress may easily be strapped together. By integrating the straps, the rolling and strapping process is easier and ensures that all users have the proper materials at hand to roll the mattress for transport.

Figure 4B:
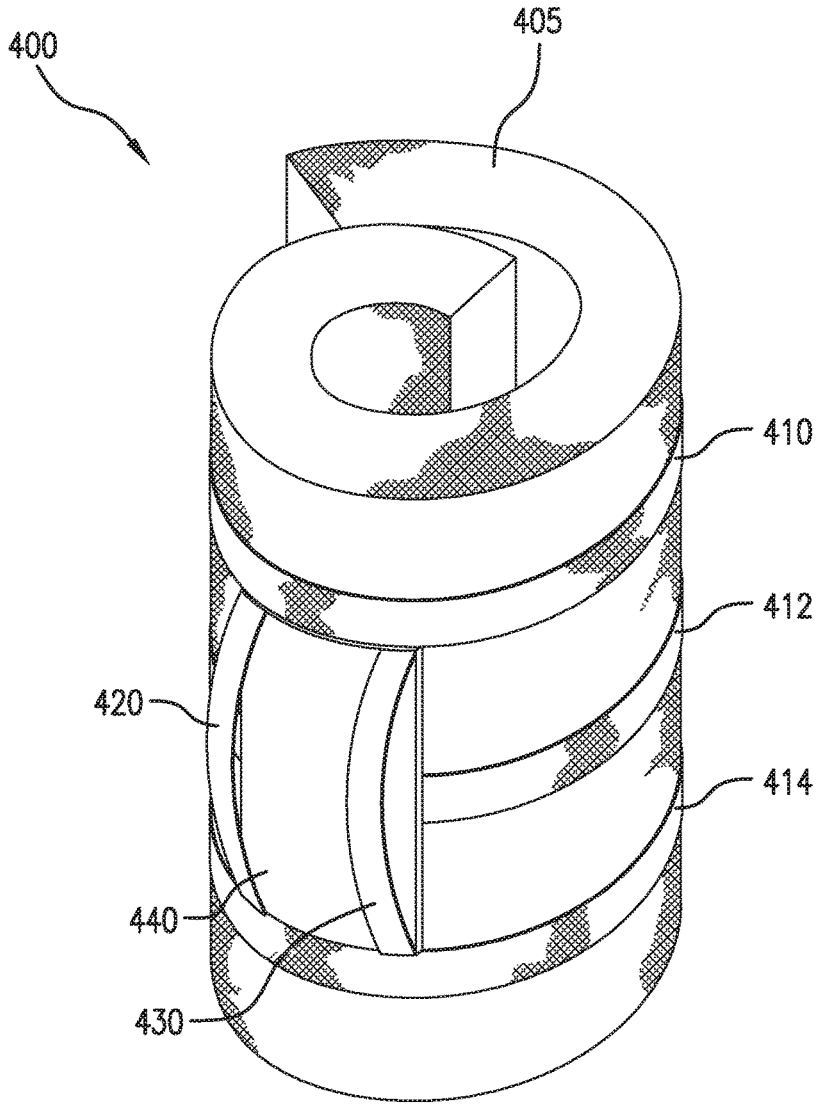

Turing to FIG. 4B, shown is another view of the mattress system 400. In addition to the straps 410, 412, 44, the mattress body 405 has integrated backpack, shoulder and/or hand straps 420, 430 installed via a securing mechanism 440 that allow the mattress body 405 to be readily carried by one or more people on their shoulders and/or back. This greatly facilitates portability, increasing the odds that an owner will take their mattress with them to their new home and be able to do so with minimal hassle.

In another embodiment, the cinch straps and carrying straps are part of a separate "wrap" or bag rather than integrated into the mattress.

VII. Integrated Mattress Washable Pad

Mattresses are expensive investments that often become stained with sweat and/or other bodily fluids. Even when used with sheets and a mattress pad (a separately-purchased cover that is used to protect the mattress), mattresses become stained. In nearly all cases, the cover of the mattress itself is not washable other than through spot cleaning. A limited number of mattresses (often futon-style) may have a cover that completely zips off and can be laundered, but this is often a cumbersome process because it requires a lot of manipulation of the heavy mattress. Staining of mattresses limits their resale value and can prevent people from giving a mattress to friends when they decide to move town or upgrade to a different mattress.

Figure 5A:
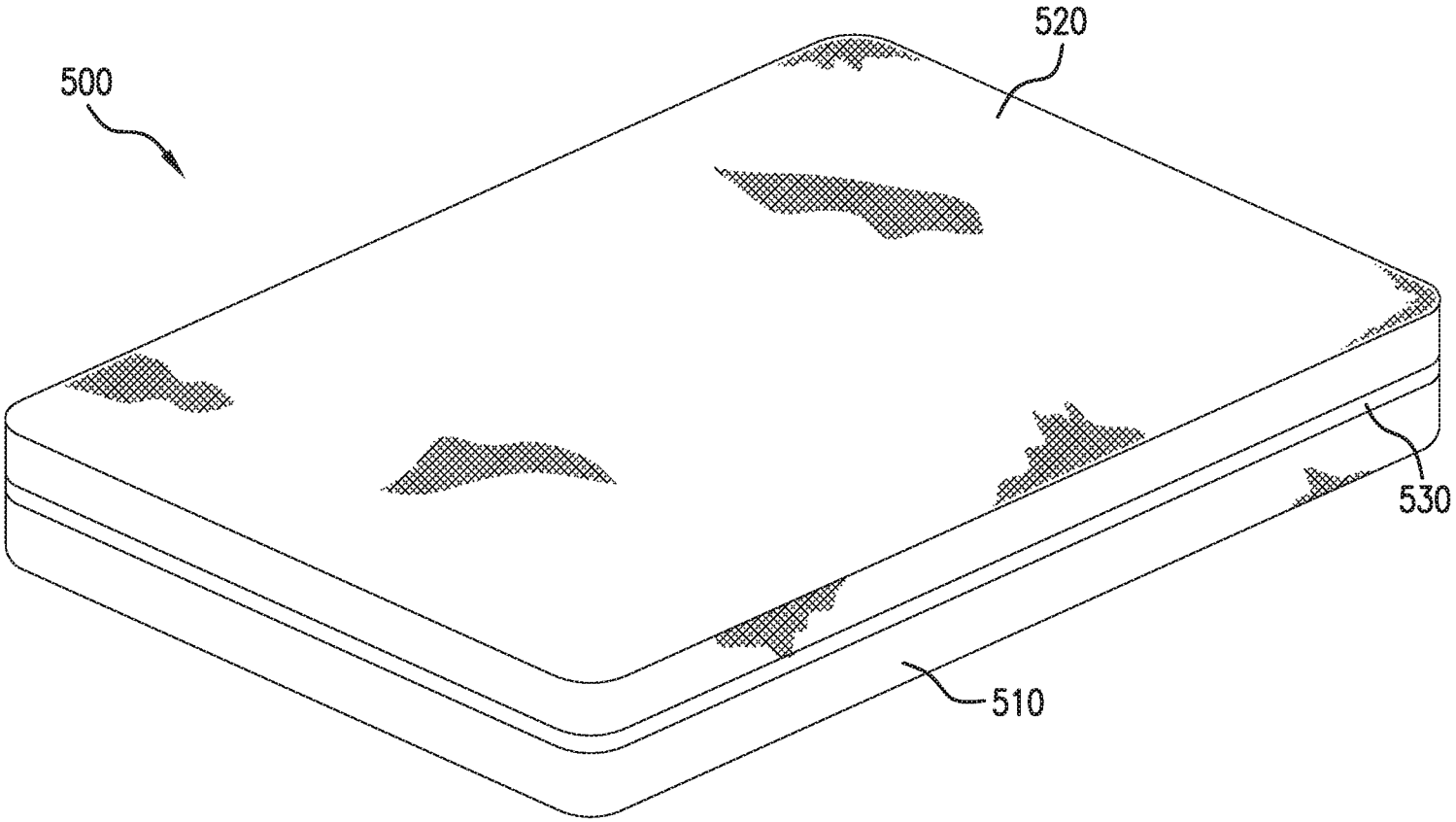
FIGS. 5A and 5B are perspective views of a mattress with a removable cover in accordance with some embodiments.

Turing to FIG. 5A, shown is a mattress system 500 including a mattress body 510 and of a removable section of a detachable mattress cover 520 that protects the primary mattress cover from stains and that can be washed or replaced with a new one in order to "refresh" the mattress. In this embodiment, the mattress cover 520 covers the entire top of the mattress body 510 and is secured to the mattress body 510 by a securing mechanism 530. It may be reversible to quickly provide a clean top surface, and it may have different colors from the mattress body 510 in order to better hide stains.

The securing mechanism 530 may be secured at approximately the same depth all around the mattress body 510 and may consist of hook and loop fasteners, zippers, buttons, snaps, ties or any combination thereof.

Figure 5B:
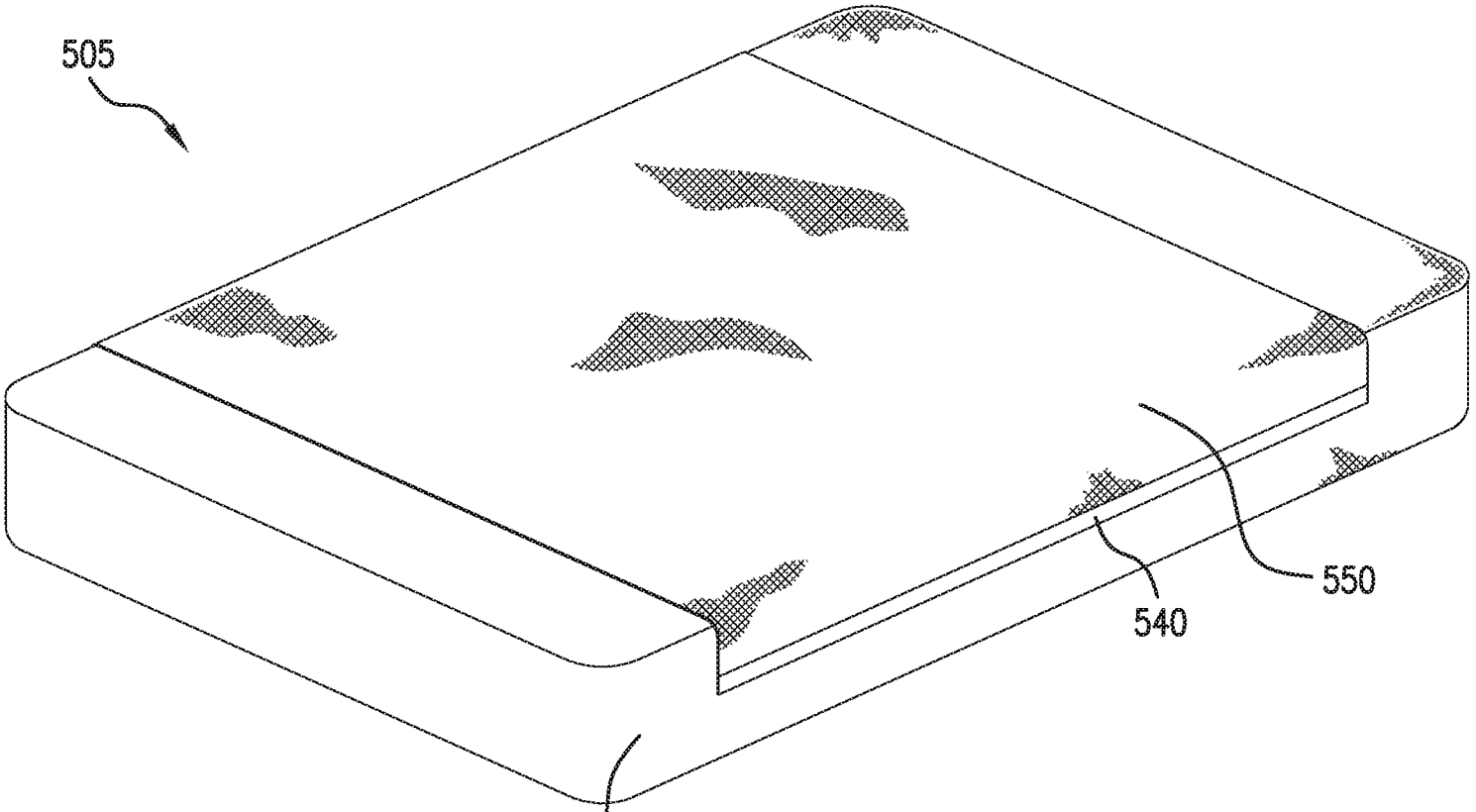

Turing to FIG. 5B, shown is a mattress system 505 including a mattress body 510 and a removable section of a detachable mattress cover 550 that protects the primary mattress cover from stains and that can be washed or replaced with a new one in order to "refresh" the mattress. In this embodiment, the mattress cover 550 covers a portion of the top of the mattress body 510 and is secured to the mattress body 510 by a securing mechanism 540. The mattress cover 550 may be located in the area most likely to absorb bodily fluids (in the region from the head to the upper thigh). It may cover just the top of the mattress body 510 so it can be easily removed and laundered. It may be reversible to quickly provide a clean top surface, and it may have different colors from the primary mattress in order to better hide stains.

The securing mechanism 540 may be secured at approximately the same depth around the mattress body 510 to best secure the mattress cover 550 The securing mechanism 540 may consist of hook and loop fasteners, zippers, buttons, snaps, ties or any combination thereof.

Figures 6A, 6B:
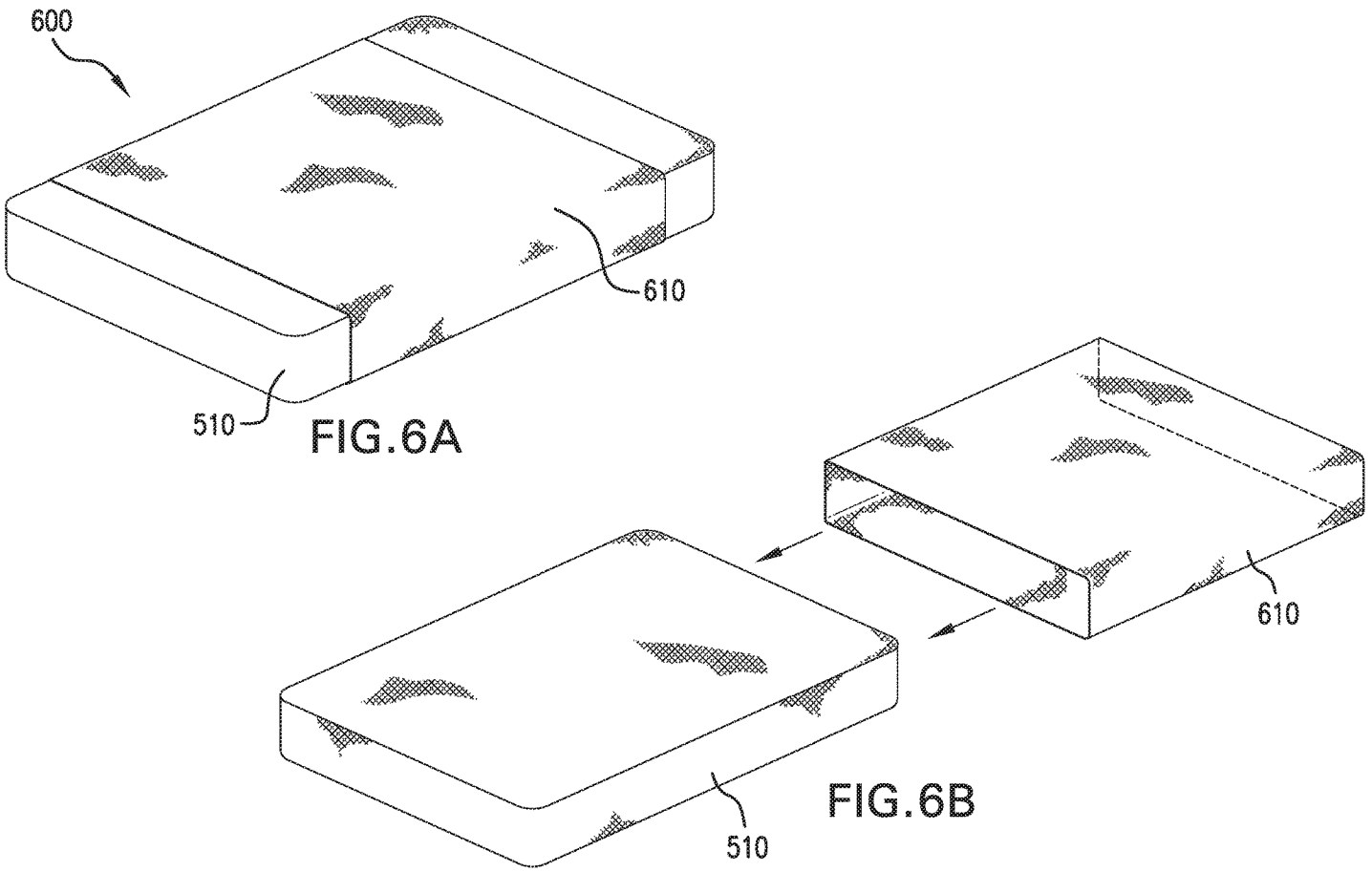
FIGS. 6A and 6B are perspective views of a mattress with a removable cover in accordance with some embodiments.

Turing to FIGS. 6A and 6B, shown is a mattress system 600 with a removable mattress pad 610 that surrounds a portion of the mattress body 510. The mattress pad 610 may be placed in the area most likely to absorb bodily fluids (in the region from the head to the upper thigh). It may cover just the top of the mattress body 510 so it can be easily removed and laundered. It may be reversible to quickly provide a clean top surface, and it may have different colors from the primary mattress in order to better hide stains.

Figure 7B:
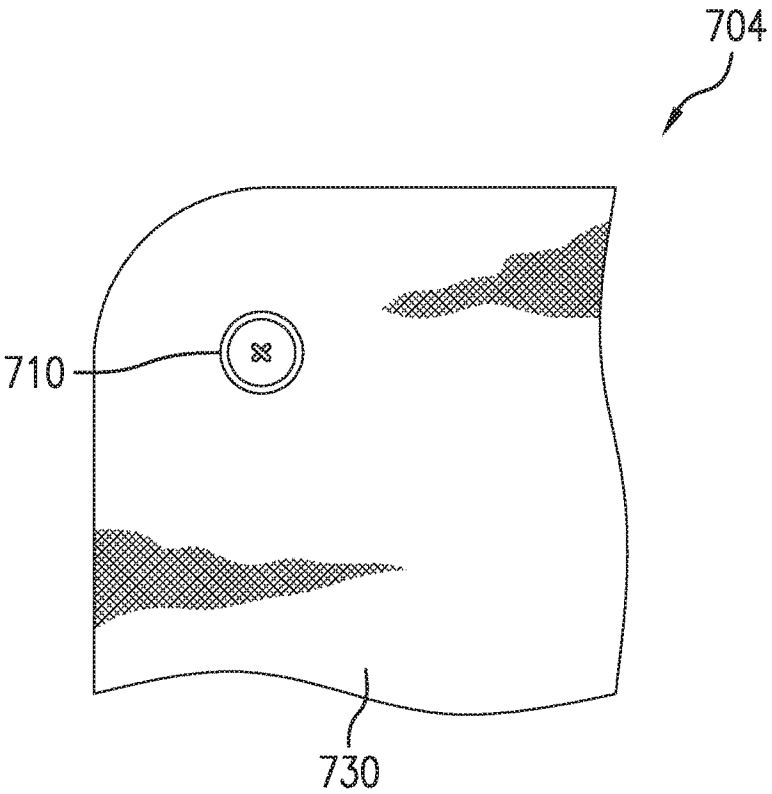
FIGS. 7A, 7B and 7C are perspective views of a mattress with a button-down cover in accordance with some embodiments.
Figure 7A:
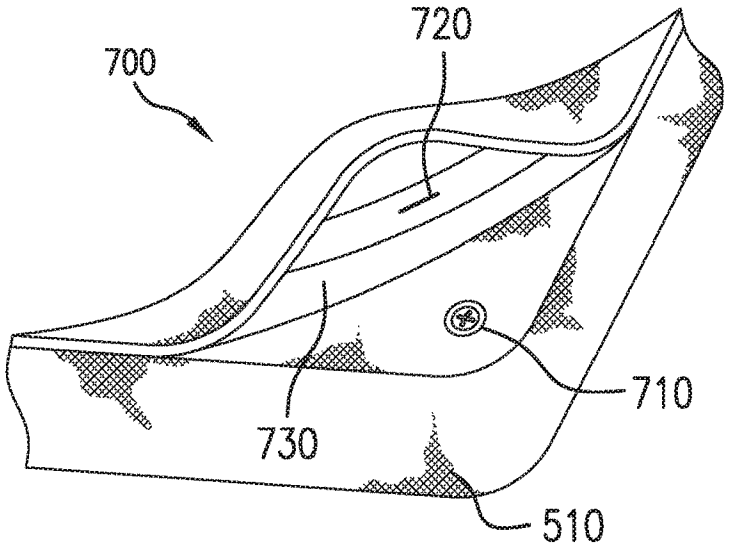
Figure 7C:
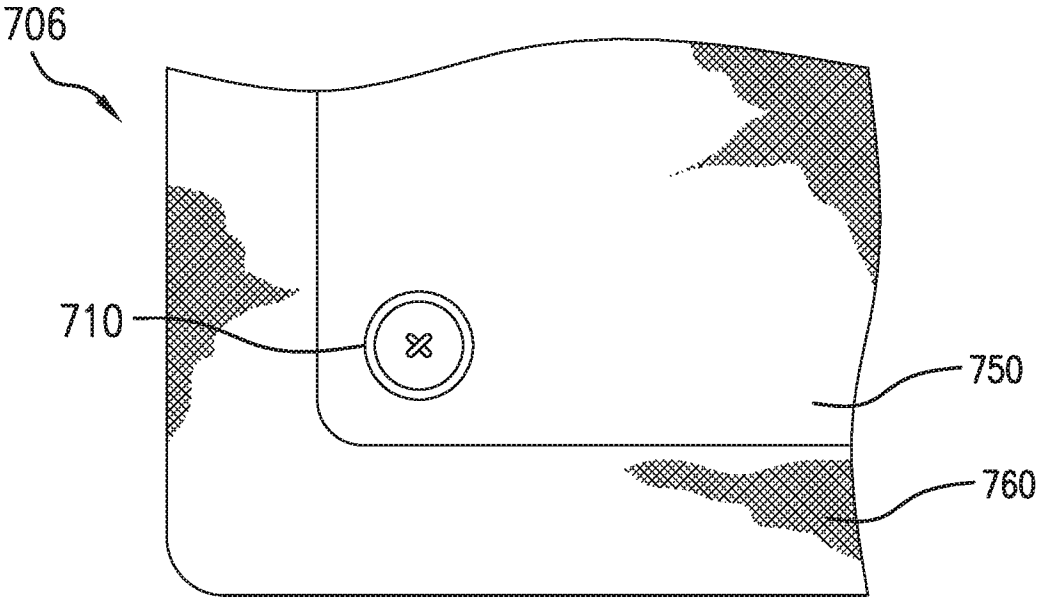

Turing to FIG. 7A, shown is a mattress system 700 with a removable mattress pad 730. It is secured to the mattress body 510 via a button 710 attached to the mattress body 510 and a button hole 720 installed in the mattress pad 730. Turning to FIG. 7B, shown is a mattress system 704 where the mattress pad 730 is attached to the mattress body (not shown) by means of the button 710 attached to the mattress. Turning to FIG. 7C, shown is a mattress system 706 where the mattress pad 750 is attached to a portion of the mattress body 760 via a button 710 attached to the mattress body 760. The mattress pads 730, 750 may be reversible to quickly provide a clean top surface, and may have different colors from the primary mattress in order to better hide stains.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An apparatus comprising:

a mattress, the mattress comprising a first horizontal layer, a second horizontal layer positioned below the first horizontal layer, a third horizontal layer positioned below the second horizontal layer, and a fourth horizontal layer positioned below the third horizontal layer;

wherein the first horizontal layer comprises latex foam;

wherein the second horizontal layer comprises memory foam;

wherein the third horizontal layer comprises transition foam;

wherein the fourth horizontal layer comprises polyurethane;

wherein the first horizontal layer has a density of approximately between 3.3 to 3.7 pounds per cubic foot, a rebound of approximately 35% or greater, and an airflow of approximately 4 cubic feet per minute or greater; and wherein the third horizontal layer has a density of approximately between 2.4 to 2.6 pounds per cubic foot, a rebound of approximately 8% to 12%, and an airflow of approximately 1.5 cubic feet per minute or greater.

2. The apparatus as in claim 1, wherein the second horizontal layer has a density of approximately between 3.3 to 3.7 pounds per cubic foot.

3. The apparatus as in claim 1, wherein the second horizontal layer has a rebound of approximately 1% or less.

4. The apparatus as in claim 1, wherein the second horizontal layer has an airflow of approximately 2 cubic feet per minute or greater.

5. The apparatus as in claim 1, wherein the second horizontal layer has a recovery of approximately between 4 to 8 seconds.

6. The apparatus as in claim 1, wherein the second horizontal layer has a glass transition temperature of 50 degrees Fahrenheit or less.

7. An apparatus comprising:

a mattress, the mattress comprising a first horizontal layer, a second horizontal layer positioned below the first horizontal layer, a third horizontal layer positioned below the second horizontal layer, and a fourth horizontal layer positioned below the third horizontal layer;

wherein the first horizontal layer comprises latex foam;

wherein the second horizontal layer comprises memory foam;

wherein the third horizontal layer comprises transition foam;

wherein the fourth horizontal layer comprises polyurethane;

wherein the first horizontal layer has a density of approximately between 3.3 to 3.7 pounds per cubic foot, a rebound of approximately greater than 35%, and an airflow of approximately 4 cubic feet per minute or greater;

wherein the second horizontal layer has a density of approximately between 3.3 to 3.7 pounds per cubic foot, a rebound of approximately 1% or less, an airflow of approximately 2 cubic feet per minute or greater, a recovery of approximately between 4 to 8 seconds, and a glass transition temperature of 50 degrees Fahrenheit or less;

wherein the third horizontal layer has a density of approximately between 2.4 to 2.6 pounds per cubic foot, a rebound of approximately 8% to 12%, and an airflow of approximately 1.5 cubic feet per minute or greater; and wherein the fourth horizontal layer has a density of approximately between 1.7 to 1.9 pounds per cubic foot.

* * * * *